US007234630B2

(12) United States Patent
Wang

(10) Patent No.: US 7,234,630 B2
(45) Date of Patent: Jun. 26, 2007

(54) FOLDING COLLAPSIBLE STORAGE CONTAINER

(76) Inventor: Wen-Tsan Wang, 6F, No. 300, Jui Kuang Rd., Taipei City (TW)

( * ) Notice: Subject to any disclaimer, the term of this patent is extended or adjusted under 35 U.S.C. 154(b) by 57 days.

(21) Appl. No.: 11/148,235

(22) Filed: Jun. 9, 2005

(65) Prior Publication Data

US 2006/0278690 A1 Dec. 14, 2006

(51) Int. Cl.
*B65D 25/04* (2006.01)

(52) U.S. Cl. ..... 229/120.31; 220/520; 220/529; 229/120.33; 229/120.37

(58) Field of Classification Search ..... 229/120.31, 229/120.33, 120.37, 120.38; 220/507, 520, 220/529, 530; 217/18, 19, 20, 22, 25, 30
See application file for complete search history.

(56) References Cited

U.S. PATENT DOCUMENTS 2,485,028 A * 10/1949 Bauernfreund et al. ..... 220/552
2,537,299 A * 1/1951 Brady et al. ..... 217/19
2,782,951 A * 2/1957 Inman ..... 229/120.31
3,064,872 A * 11/1962 Skirow ..... 229/120.35
3,491,909 A * 1/1970 Ikelheimer ..... 220/529
3,843,039 A * 10/1974 Brown et al. ..... 229/120.31
4,927,073 A * 5/1990 Esposito ..... 229/120.31
4,951,867 A * 8/1990 McManus ..... 229/120.31
5,004,146 A * 4/1991 Thominet et al. ..... 229/120.31
5,167,363 A * 12/1992 Adkinson et al. ..... 229/120.31
5,791,481 A * 8/1998 Thomas ..... 220/507
2006/0011686 A1* 1/2006 Latham ..... 220/529

* cited by examiner

*Primary Examiner*—Gary E. Elkins
(74) *Attorney, Agent, or Firm*—Leong C. Lei

(57) ABSTRACT

Disclosed is a folding collapsible storage container, which has a container body with vertical folding lines in the four corners and two opposite short sides thereof, a stiff partition plate fixedly fastened to the container body set between the vertical folding lines in the two opposite short sides of the container body, flexible spacer members connected between the partition plate and two opposite long sides of the container body, and a hard bottom board detachably mounted in the flexible bottom panel of the container body.

2 Claims, 4 Drawing Sheets

FOLDING COLLAPSIBLE STORAGE CONTAINER

BACKGROUND OF THE INVENTION (a) Technical Field of the Invention

The present invention relates to storage containers and more particularly, to a folding collapsible storage container, which has multiple compartments for keeping things in good order.

(b) Description of the Prior Art

In order to save storage space, many storage box suppliers provide different designs of folding collapsible storage boxes. A folding collapsible storage box is known comprising a flexible rectangular cloth box body and a plurality of rod members supporting the cloth box body in shape. These rod members include four horizontal top rods, four horizontal bottom rods, and four vertical corner rod members. When assembled, the rod members are kept spaced apart from one another at a distance so that the storage box can be twisted and then folded into a flat status having a reduced size. This structure of storage box is complicated and not convenient to operate. Further, this storage box does not allow installation of hard partition members in the cloth box body to divide the internal holding space into multiple compartments for storing socks, briefs, handkerchiefs, towels, etc. in good order, because hard partition members will hinder the folding of the cloth box body. If hard partition members are made detachable, the user must keep the detached hard partition members in place after removal from the cloth box body.

SUMMARY OF THE INVENTION

The primary purpose of the present invention is to provide a folding collapsible storage container that can conveniently collapsed and received in a flat manner without removing the internal partition plates. According to one embodiment of the present invention, the A folding collapsible storage container comprises a rectangular container body, the rectangular container body having four upright peripheral panels, a flexible horizontal bottom panels, and a plurality of vertical folding lines in four corners thereof between each two adjacent upright peripheral panels and the middle of each of two opposite ones of the upright peripheral panels at two opposite short sides of the rectangular container body, the flexible horizontal bottom panel being made in the form of a pocket defining a receiving hole; a hard bottom panel insertable into the receiving hole of the flexible horizontal bottom panel to support the flexible horizontal bottom panel in shape; a stiff partition plate set in the rectangular container body between the vertical folding lines at the two opposite upright peripheral panels at two opposite short sides of the rectangular container body; and a plurality of flexible spacer panels respectively connected between two sides of the stiff partition plate and two upright peripheral panels of the rectangular container body at two opposite long sides of the rectangular container body. According to a second embodiment of the present invention, multiple stiff partition plates are set in parallel in the rectangular container body, and multiple flexible spacer panels are respectively connected between each two adjacent stiff partition plates and between each of the two upright peripheral panels at two opposite long sides of the rectangular container body and the respective adjacent stiff partition plates.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
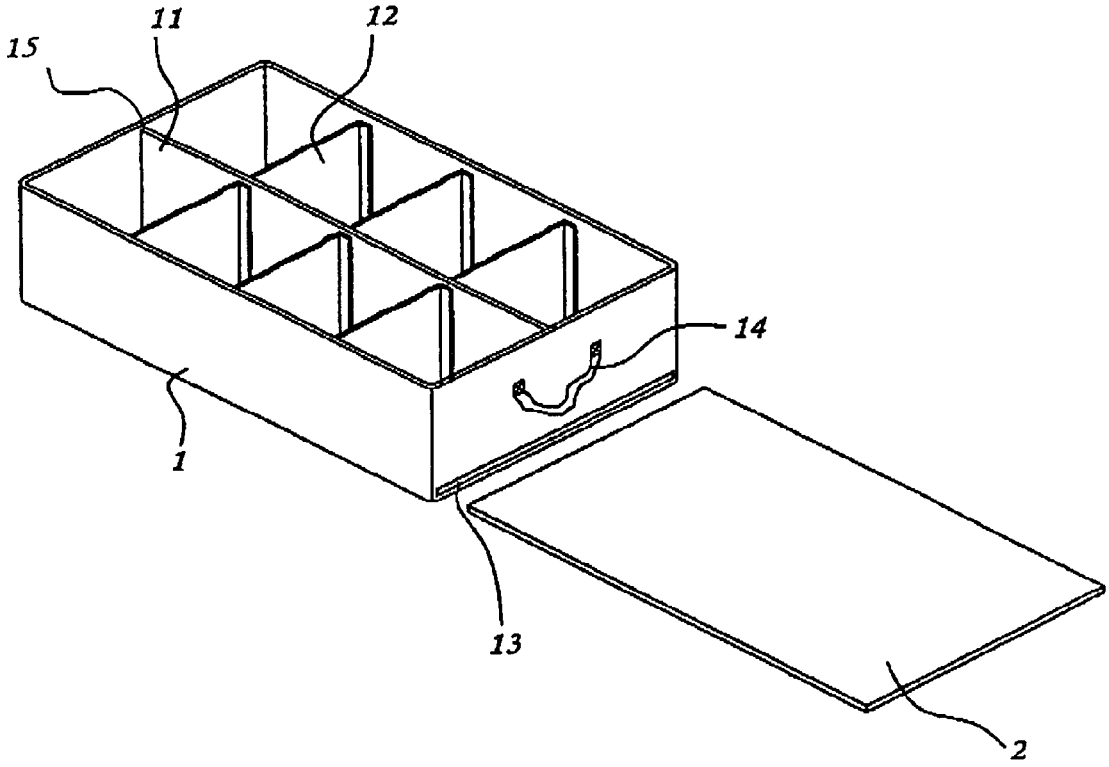
FIG. 1 is an exploded view of a folding collapsible storage container according to a first embodiment of the present invention.
Figure 2:
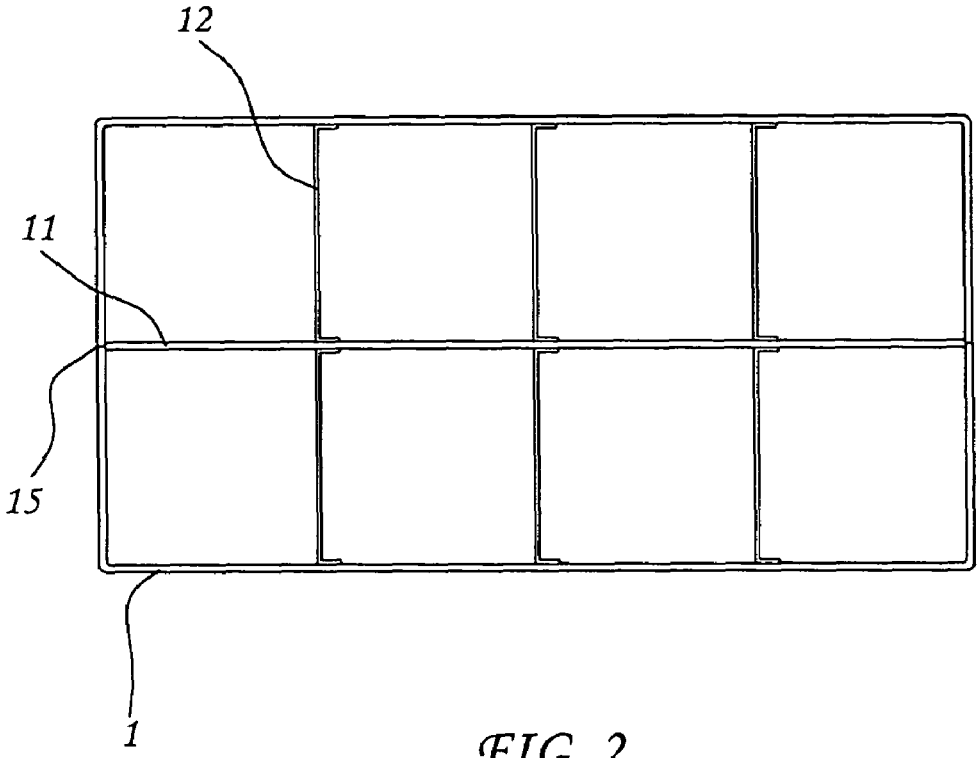
FIG. 2 is a top plain view of the folding collapsible storage container according to the first embodiment of the present invention.

Referring to FIGS. 1 and 2, a folding collapsible storage container in accordance with the first embodiment of the present invention is shown comprising a rectangular container body 1, a stiff partition plate 11, a plurality of flexible spacer panels 12, and a hard bottom board 2. The rectangular container body 1 has four upright peripheral panels and a horizontal bottom panel. The upright peripheral panels of the rectangular container body 1 are preferably formed of a tough and stiff plate member covered with a cloth covering. The horizontal bottom panel of the rectangular container body 1 is preferably made of a flexible sheet material. When the upright peripheral panels and the horizontal bottom panel are fastened together to form the rectangular container body 1, vertical folding lines 15 in the four corners between each two adjacent upright peripheral panels and the middle of each of the two opposite upright peripheral panels at the two opposite short sides of the rectangular container body 1. Further two handles 14 are respectively provided the two opposite upright peripheral panels at the two opposite short sides of the rectangular container body 1. The stiff partition plate 11 has a length approximately equal to the length of the long sides of the rectangular container body 1 and a height approximately equal to the height of the upright peripheral sides of the rectangular container body 1, and is longitudinally set in the rectangular container body 1 between the folding lines 15 at the two upright peripheral panels at the two opposite short sides of the rectangular container body 1. The flexible spacer panels 12 are fabric sheet members symmetrically set at two sides between two sides of the stiff partition plate 11 and the two upright peripheral panels at the two opposite long sides of the rectangular container body 1. Preferably, the flexible spacer panels 12 are fastened to the (soft covering of the) stiff partition plate 11 and the respective upright peripheral panels of the rectangular container body 1 with stitches. Further, the horizontal bottom panel of the rectangular container body 1 is made in the form of a pocket defining a receiving hole 13.

Figure 3:
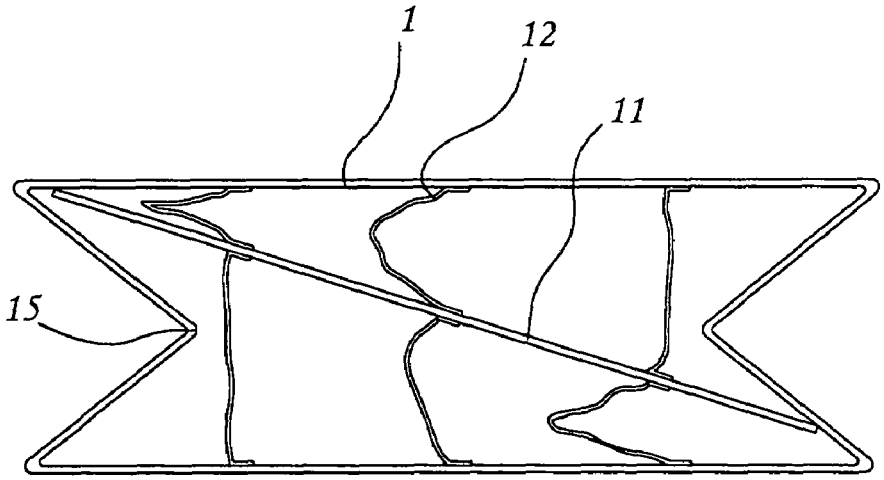
FIG. 3 is a schematic drawing showing the folding status of the folding collapsible storage container according to the first embodiment of the present invention.

After setting of the stiff partition plate 11 in between the folding lines 15 at the two upright peripheral panels at the two opposite short sides of the rectangular container body 1. The hard bottom board 2 is inserted into the receiving hole 13 in the horizontal bottom panel of the rectangular container body 1 to support the horizontal bottom panel of the rectangular container body 1 in shape. When assembled, the stiff partition plate 11 and the flexible spacer panels 12 divide the holding space of the rectangular container body 1 into multiple storage cells for keeping things in order. When not in use, remove the hard bottom board 2 from the rectangular container body 1, and then bias the stiff partition plate 11 to receive the rectangular container body 1 in a collapsed flat manner as shown in FIG. 3.

Figure 4:
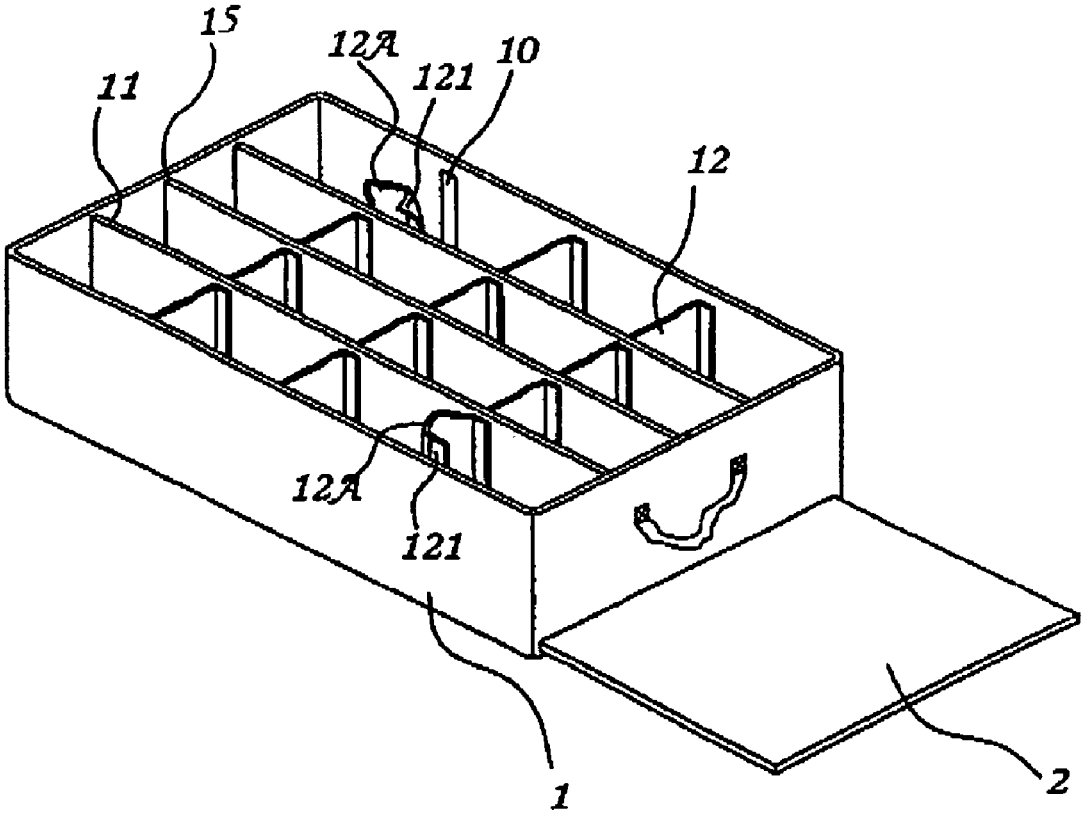
FIG. 4 is an elevated view of a folding collapsible storage container according to a second embodiment of the present invention, showing the hard bottom board partially extended out of the horizontal bottom panel of the rectangular container body.

FIG. 4 shows a folding collapsible storage container according to the second embodiment of the present invention. According to this embodiment, the folding collapsible storage container comprises a rectangular container body 1, a plurality of stiff partition plates 11, a plurality of flexible spacer panels 12, and a hard bottom board 2. The structure of the rectangular container body 1 of this second embodiment is same as that of the aforesaid first embodiment. The stiff partition plates 11 are set in parallel between vertical folding lines 15 at the two upright peripheral panels at the two opposite short sides of the rectangular container body 1. The flexible spacer panels 12 are respectively transversely fastened to the stiff partition plates 11 and the two upright peripheral panels at the two opposite long sides of the rectangular container body 1. The hard bottom board 2 is inserted into the receiving hole (not shown) in the horizontal bottom panel of the rectangular container body 1.

Figure 5:
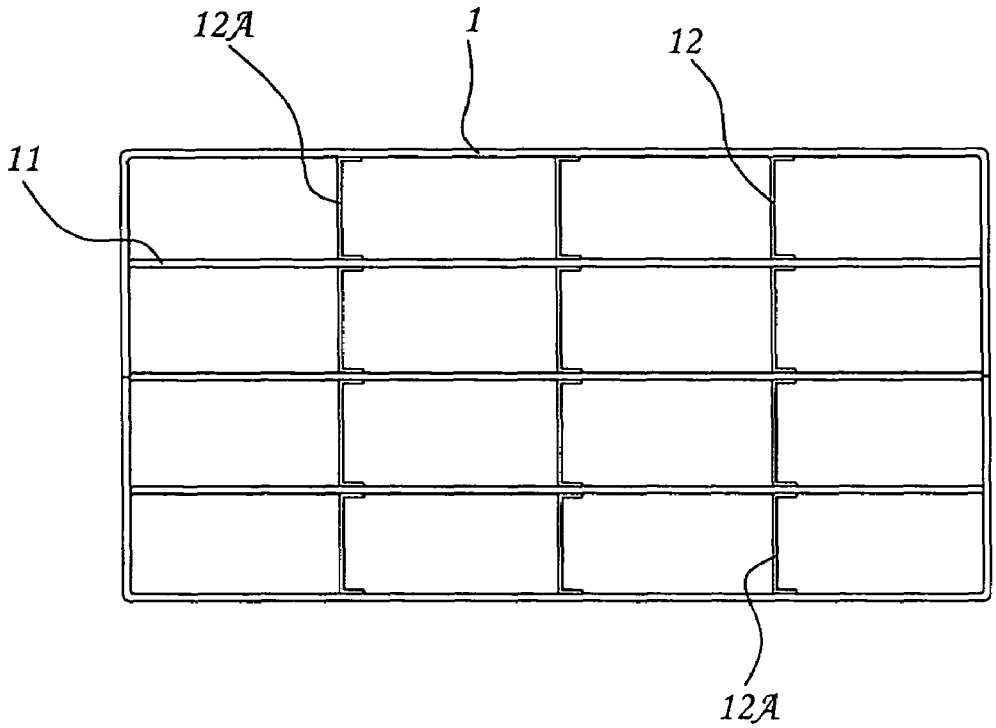
FIG. 5 is a top plain view of the folding collapsible storage container according to the second embodiment of the present invention.
Figure 6:
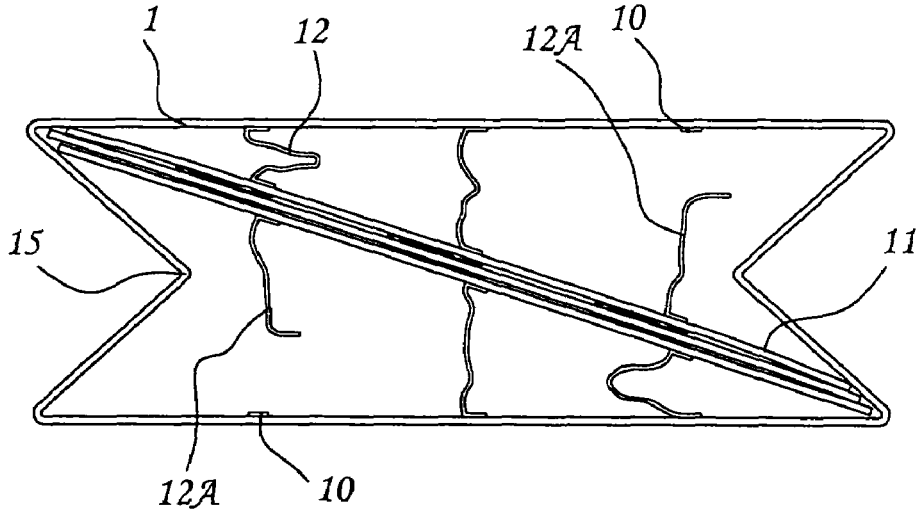
FIG. 6 is a schematic drawing showing the folding status of the folding collapsible storage container according to the second embodiment of the present invention.

Because multiple stiff partition plates 11 are set in the rectangular container body 1, the biasing angle of the stiff partition plates 11 is limited to a relatively smaller range when compared to the aforesaid first embodiment. In order to eliminate this problem, the two flexible spacer panels 12A in two diagonal corners of the rectangular container body 1 are made detachable, i.e., the two flexible spacer panels 12A each have one end fixedly fastened to the respective adjacent stiff partition plate 11 and the other end fixedly provided with a tape of hook (loop) material 121 that is detachably fastened to a respective tape of loop (hook) material 10 at the rectangular container body 1. After the rectangular container body 1 has been set in shape, the tapes of hook (loop) material 121 are respectively fastened to the tapes of loop (hook) material 10 (see FIG. 5). When not in use, the tapes of hook (loop) material 121 are respectively disconnected from the tapes of loop (hook) material 10, and then the stiff partition plates 11 are biased to collapse the rectangular container body 1 (see FIG. 6).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A folding collapsible storage container comprising:

a rectangular container body, said rectangular container body having four upright peripheral panels, a flexible horizontal bottom panel, and a plurality of vertical folding lines in four corners of said rectangular container body between two adjacent ones of said upright peripheral panels and two opposite ones of said upright peripheral panels at two opposite short sides of said rectangular container body, said flexible horizontal bottom panel being made in the form of a pocket defining a receiving hole;

a hard bottom panel inserted into said receiving hole of said flexible horizontal bottom panel to support said flexible horizontal bottom panel in shape;

a plurality of stiff partition plates set in said rectangular container body in vertical direction and arranged in parallel between the vertical folding lines at the two opposite upright peripheral panels at two opposite short sides of said rectangular container body; and a plurality of flexible spacer panels respectively connected between each two adjacent ones of said stiff partition plates and between said stiff partition plates and two opposite upright peripheral panels of said rectangular container body at two opposite long sides of said rectangular container body, said flexible spacer panels including two spacer panels set in two diagonal corners in said rectangular container body and respectively detachably fastened to the two opposite upright peripheral panels of said rectangular container body at the two opposite long sides of said rectangular container body with fastening elements.

2. The folding collapsible storage container as claimed in claim 1, wherein said fastening means is hook and loop materials.

* * * * *